US006827650B1

(12) United States Patent
Tseng

(10) Patent No.: US 6,827,650 B1
(45) Date of Patent: Dec. 7, 2004

(54) SWING WITH A POSITION ADJUSTING MEMBER FOR ADJUSTING A BACKREST RELATIVE TO A SEAT FRAME

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/695,028

(22) Filed: Oct. 28, 2003

(51) Int. Cl.[7] ..... A63G 9/00
(52) U.S. Cl. ..... 472/125; 472/118; 297/320
(58) Field of Search ..... 472/118–125; 297/320, 322, 317, 151, 153

(56) References Cited

U.S. PATENT DOCUMENTS 5,951,102 A * 9/1999 Poulson et al. ..... 297/130
6,419,312 B1 * 7/2002 Flannery et al. ..... 297/149
6,582,018 B2 * 6/2003 Tseng ..... 297/281
6,585,319 B2 * 7/2003 Tseng ..... 297/281
6,715,831 B1 * 4/2004 Tseng ..... 297/281

* cited by examiner

*Primary Examiner*—K. T. Nguyen
(74) *Attorney, Agent, or Firm*—Ladas & Parry LLP

(57) ABSTRACT

A swing includes a seat unit having a seat frame disposed between two armrest frames, and a backrest frame pivoted to a rear end of the seat frame and to one of the armrest frames. A sliding member is fixed to the seat frame, and is slidably mounted on a guiding rail that is secured to said one of the armrest frames. A spring-biased latch is mounted on the sliding member, and engages releasably a selected one of retaining grooves formed in the guiding rail to prevent sliding movement of the sliding member and the seat frame relative to the guiding rail.

3 Claims, 9 Drawing Sheets

SWING WITH A POSITION ADJUSTING MEMBER FOR ADJUSTING A BACKREST RELATIVE TO A SEAT FRAME

BACKGROUND OF THE INVENTION

1. Field of the Invention

The present invention relates to a swing, more particularly to a swing with a position adjusting member for adjusting a backrest relative to a seat frame.

2. Description of the Related Art

Referring to FIGS. 1 and 2, in a U.S. patent application Ser. No. 10/603,013 filed by the applicant, there is disclosed a swing 1 which includes a vertical support unit 11, and a seat unit 2 having inverted U-shaped left and right armrest frames 212 connected swingably to a top end of the support unit 11 through suspending rods 12. The seat unit 2 includes front and rear connecting rods 211 interconnecting lower ends of the left and right armrest frames 212, a seat frame 221 disposed above the front connecting rod 211 and between the left and right armrest frames 212, and a backrest frame 222 pivoted to a rear end of the seat frame 221 through a first pivot pin (X) and to one of the left and right armrest frames 212 about a second pivot pin (Y) that is disposed above the first pivot pin (X), a footrest frame 223 pivoted to a front end of the seat frame 221 through a third pivot pin (Z), and an inclination adjusting rod 213 connected pivotally to the footrest frame 223 and a lower end of the backrest frame 222. A positioning unit 23 includes a sliding member 235, a guiding member 232, and a fastener 237. The guiding member 232 is secured to said one of the armrest frames 212. The sliding member 235 is fixed to the seat frame 221, and is mounted slidably on the guiding member 232. The fastener 237 fastens releasably the sliding member 235 to the guiding member 232 to prevent sliding movement of the sliding member 235 together with the seat frame 221 on the guiding member 232.

One disadvantage of the aforementioned swing 1 resides in that it is relatively inconvenient for the user to loosen or tighten the fastener 237 relative to the guiding member 232 whenever he/she wishes to adjust the inclination of the backrest frame 222 relative to the seat frame 221. Moreover, the backrest frame 222 cannot be firmly held in position since the frictional engagement between the fastener 237 and the guiding member 232 is not sufficiently strong.

SUMMARY OF THE INVENTION

The object of this invention is to provide a swing with a position adjusting member that can be conveniently operated for adjusting the position of a backrest relative to a seat frame.

According to the present invention, a swing includes a seat unit and a support unit. The seat unit includes: front and rear connecting rods extending in a longitudinal direction; two spaced apart armrest frames extending in a transverse direction relative to the longitudinal direction, one of the armrest frames having an upper part, and front and rear parts extending downwardly and respectively from two opposite ends of the upper part and connected respectively to the front and rear connecting rods; first and second pivot pins; a seat frame disposed above the front connecting rod between the armrest frames, and including a side part adjacent to said one of the armrest frames and having opposite front and rear ends; a backrest frame disposed rearwardly of the seat frame, and including a side part having a lower end disposed below the seat frame, an upper end opposite to the lower end, and an intermediate portion pivoted to the rear end of the side part of the seat frame through the first pivot pin and to the rear part of said one of the armrest frames through the second pivot pin, which is disposed at an elevation above the first pivot pin and which is parallel to the first pivot pin; and a position adjusting member including a guiding rail that is secured to said one of the armrest frames, that is disposed between the front and rear parts of said one of the armrest frames, and that is formed with a plurality of spaced-apart retaining grooves, a sliding member connected securely to the side part of the seat frame for co-movement therewith and defining a rail passage that permits extension of the guiding rail therethrough so as to be slidable on the guiding rail, and a spring-biased latch that is mounted on the sliding member and that has an engaging end extending into the rail passage in the sliding member and engaging releasably a selected one of the retaining grooves in the guiding rail so as to prevent sliding movement of the sliding member and the seat frame on the guiding rail. The support unit includes an upright support frame having opposite top and bottom ends, and left and right suspending members having upper ends connected swingably to the top end of the support frame, and lower ends connected swingably and respectively to the seat unit.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
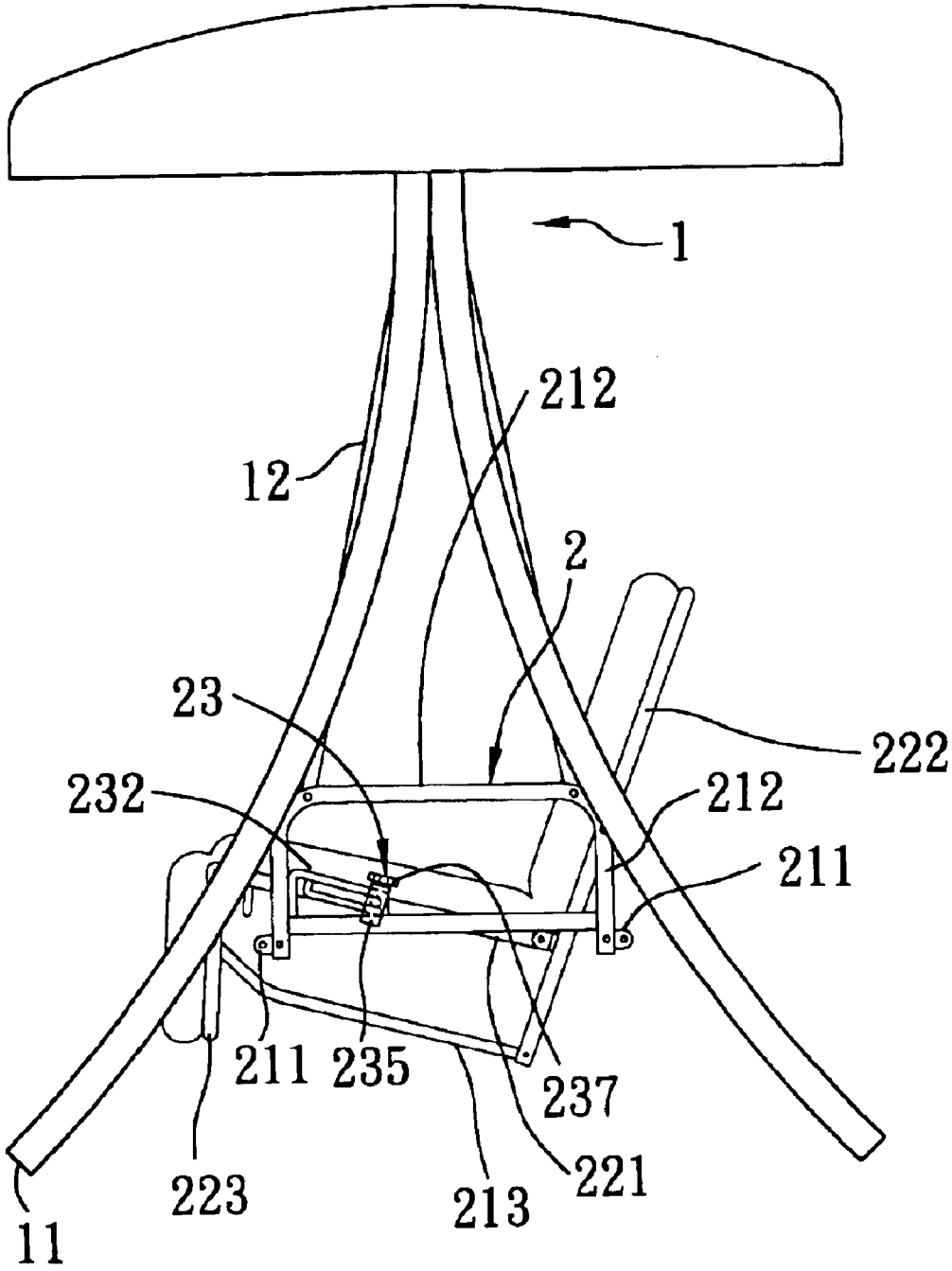
FIG. 1 is a schematic side view of a swing disclosed in a U.S. patent application Ser. No. 10/603,013 filed by the applicant.
Figure 2:
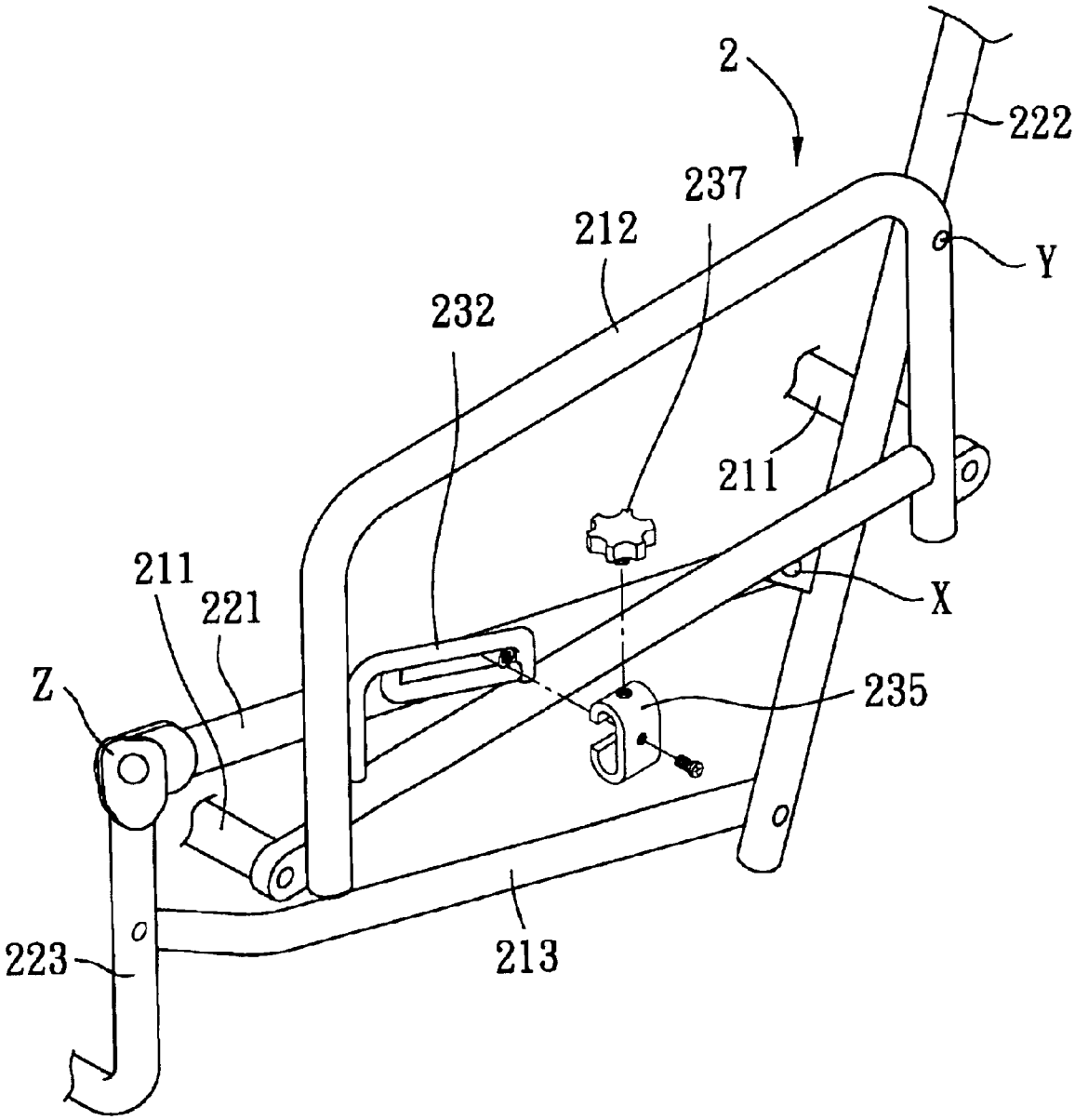
FIG. 2 is a fragmentary perspective view of the swing shown in FIG. 1.

Referring to FIGS. 3 to 6, the preferred embodiment of a swing according to the present invention is shown to include a pair of seat units 5 and a support unit 30.

As illustrated, each of the seat units 5 includes front and rear connecting rods 41,42, two spaced apart inverted U-shaped armrest frames 43, a seat frame 51, a backrest frame 52, a footrest frame 53, two inclination-adjusting rods 54 (only one is shown in the drawings), and a position adjusting member 6. The front and rear connecting rods 41,42 extend in a longitudinal direction. Each of the armrest frames 43 extends in a first transverse direction relative to the longitudinal direction, and has an upper part 433, and front and rear parts 431,432 extending downwardly and respectively from two opposite ends of the upper part 433 and connected respectively to the front and rear connecting rods 41, 42 (see FIG. 3). Each of the armrest frames 43 further has a lower reinforcing part 434 interconnecting the front and rear parts 431,432 so as to enhance rigidity of the respective armrest frame 43.

The seat frame 51 is disposed slidably above the front connecting rod 41 between the armrest frames 43, and includes right and left side parts 510 that are disposed adjacent to the armrest frames 43, respectively. Each of the right and left side parts 510 of the seat frame 51 has opposite front and rear ends.

Figure 3:
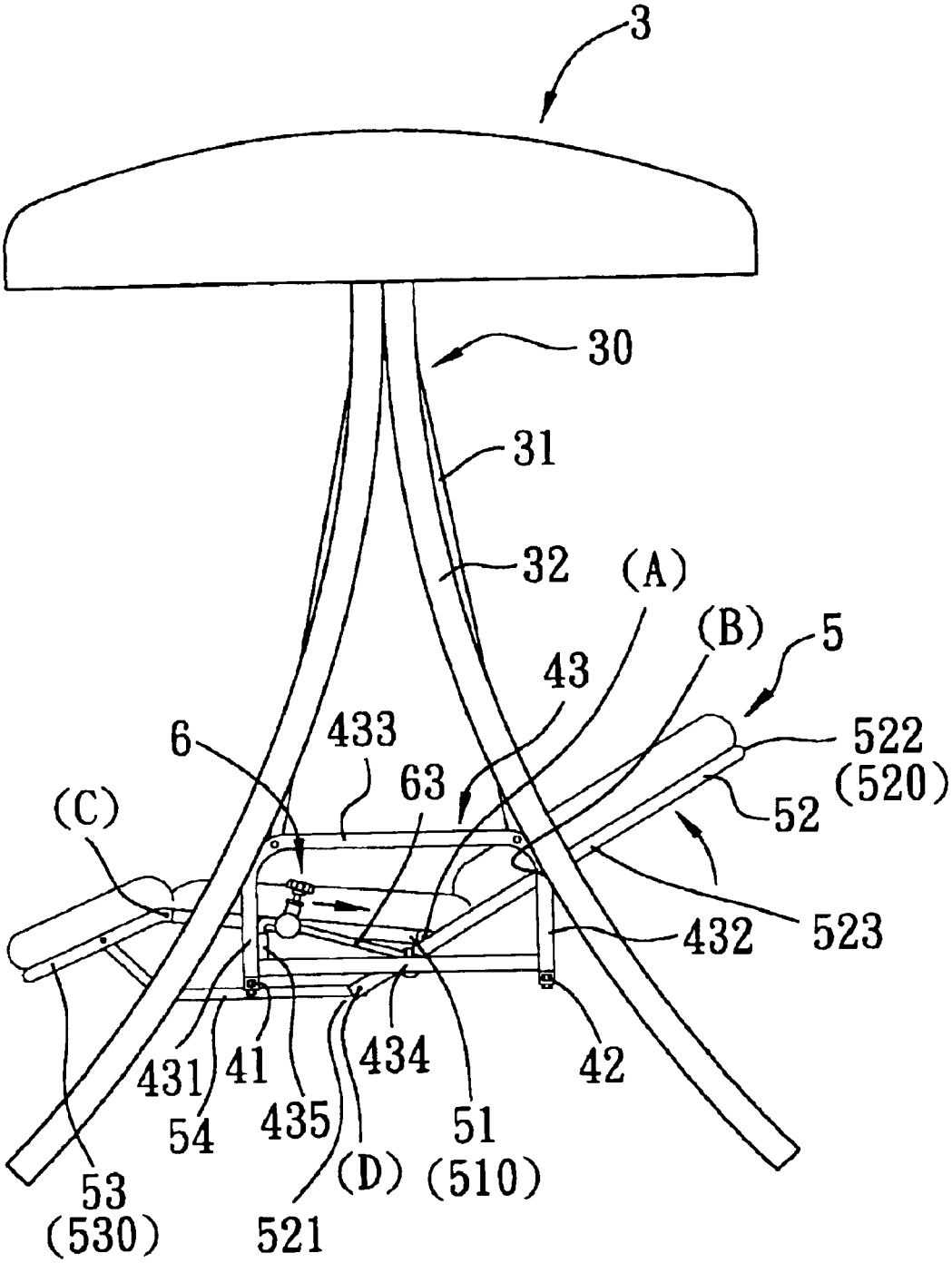
FIG. 3 is a schematic side view of the preferred embodiment of a swing according to the present invention, illustrating how a backrest frame is disposed at a tilted position relative to a seat frame by a position adjusting member.
Figure 4:
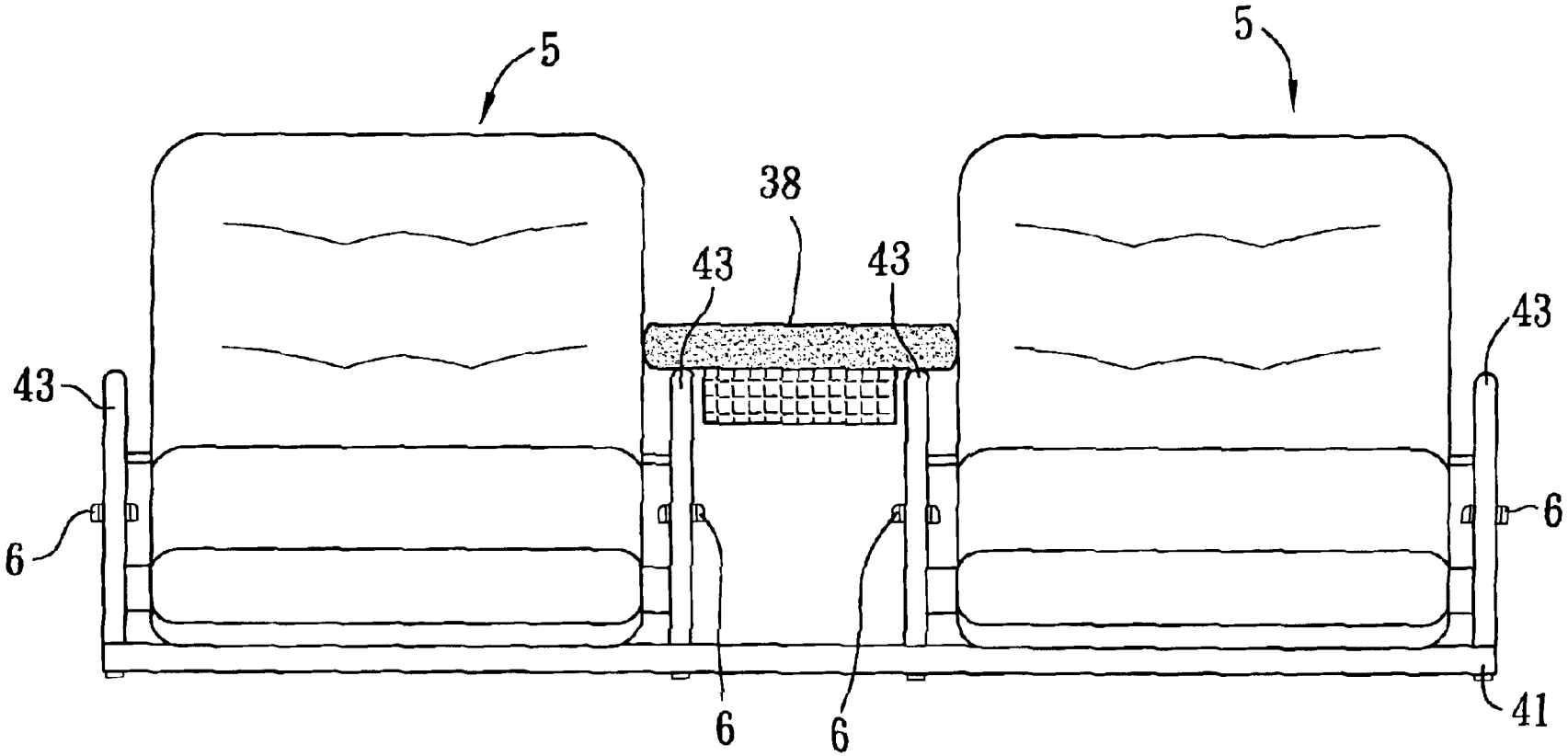
FIG. 4 is a schematic front view of a seat unit of the preferred embodiment.
Figure 5:
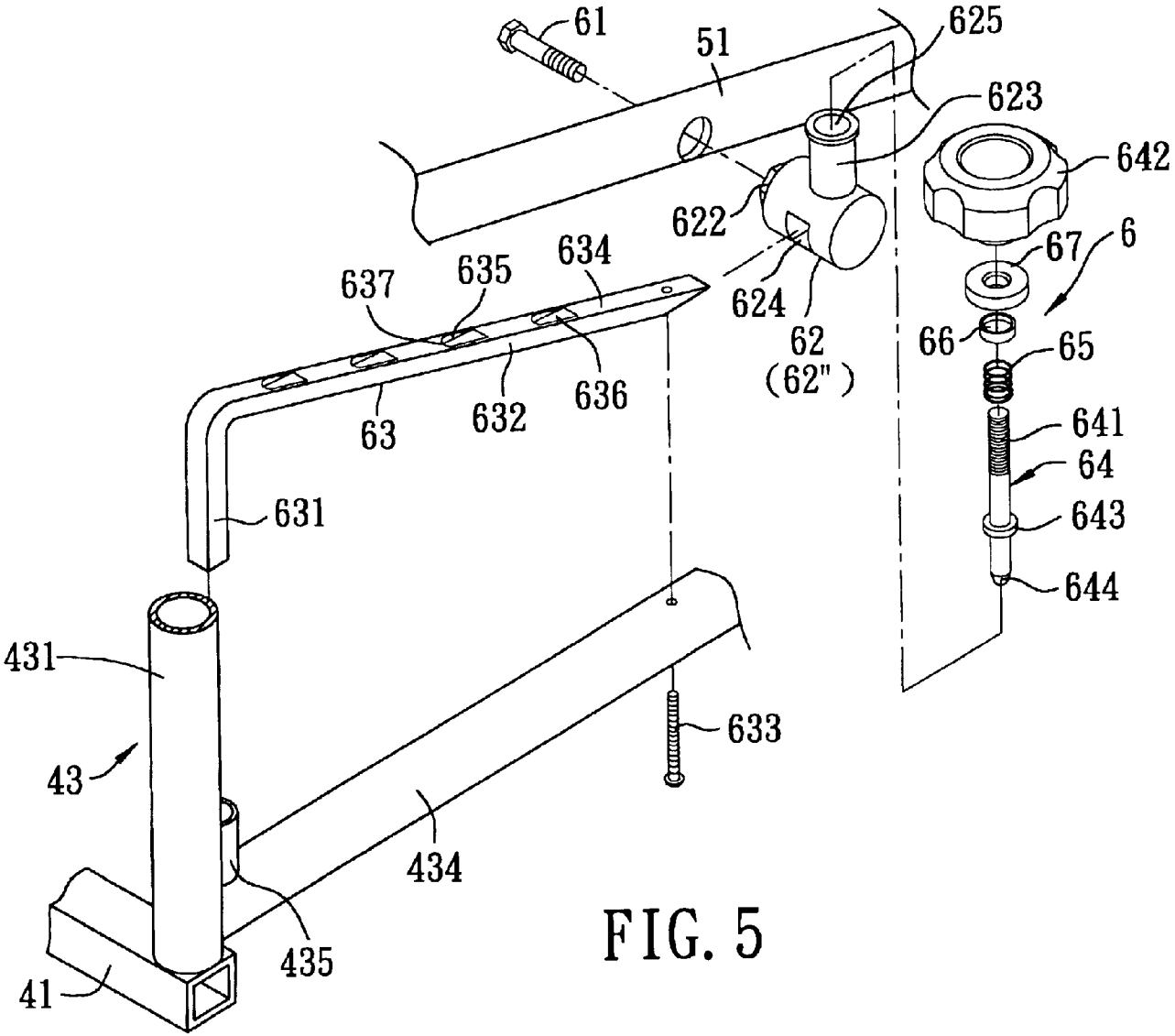
FIG. 5 is fragmentary exploded perspective view of the preferred embodiment, illustrating the construction of the position adjusting member.
Figure 6:
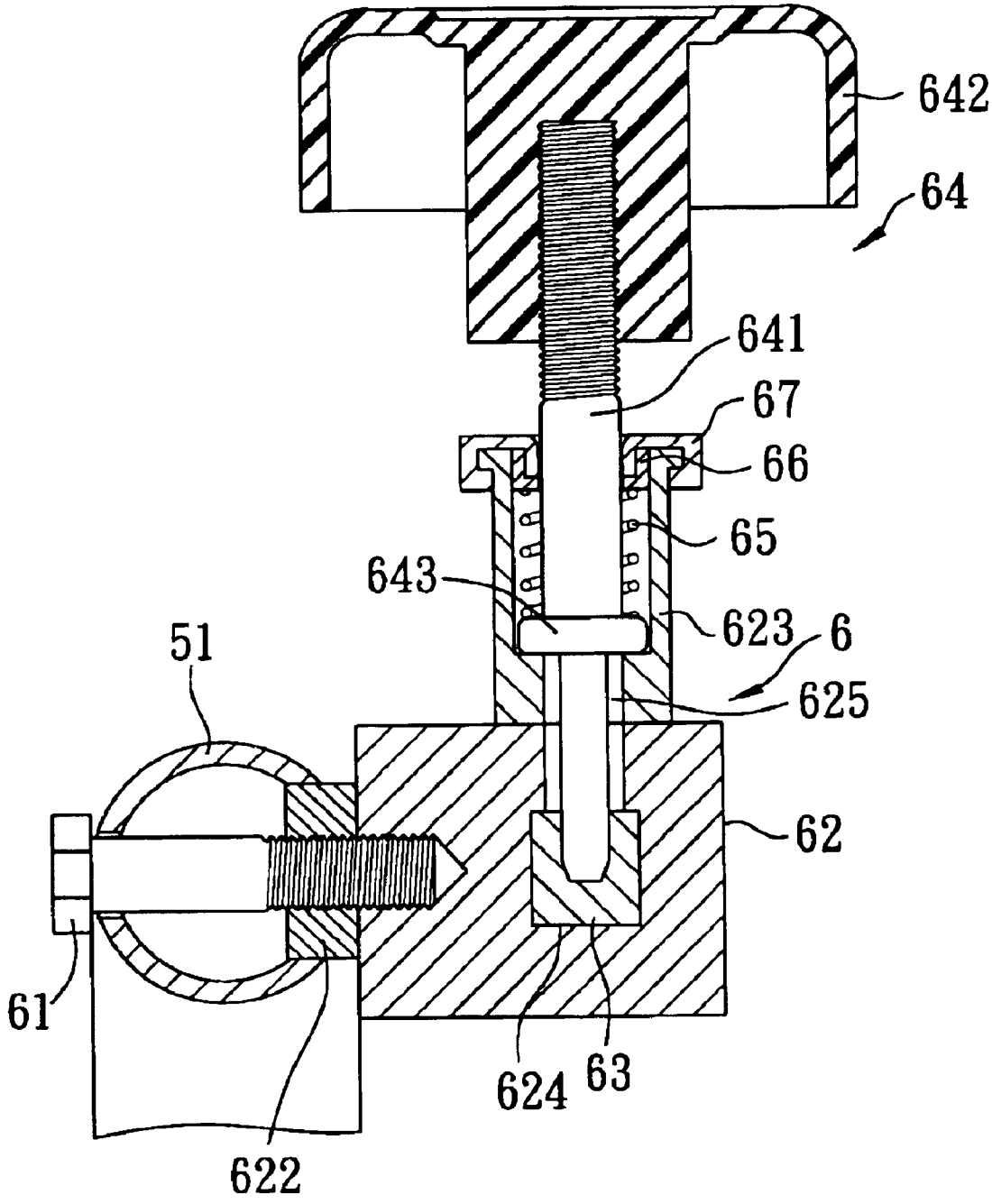
FIG. 6 is a fragmentary sectional side view of the preferred embodiment, illustrating the construction of the position adjusting member.
Figure 8:
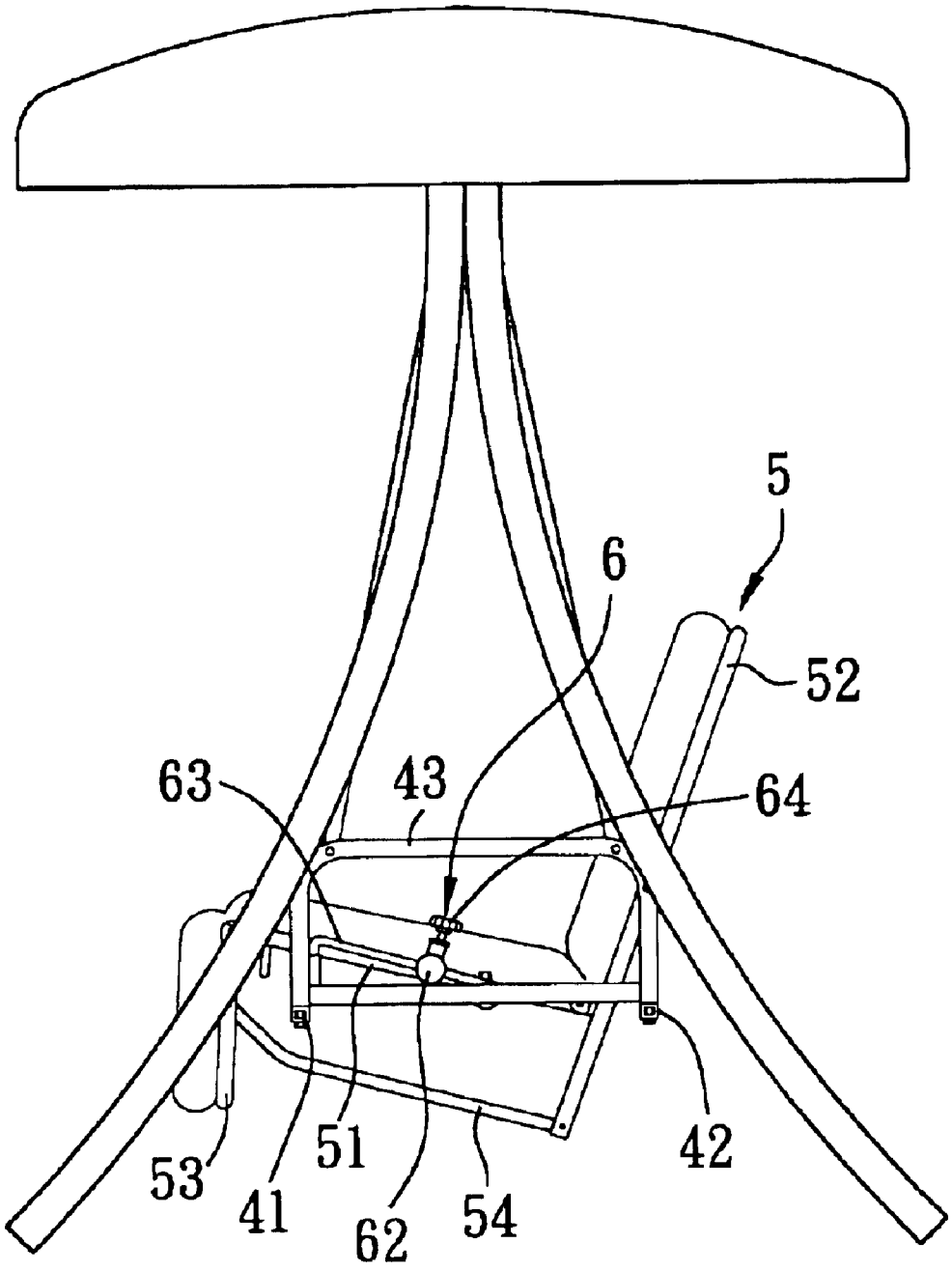
FIG. 8 is a schematic side view the preferred embodiment, illustrating the backrest frame at a normal position relative to the seat frame.

The backrest frame 52 is disposed rearwardly of the seat frame 51, extends in a second transverse direction relative to the longitudinal direction and the first transverse direction when the backrest frame 52 is disposed at a normal position (see FIG. 8), and includes right and left side parts 520, each of which has a lower end 521 disposed below the seat frame 51, an upper end 522 opposite to the lower end 521, and an intermediate portion 523 pivoted to the rear end of a respective one of the right and left side parts 510 of the seat frame 51 through a first pivot pin (A) and to the rear part 432 of a respective one of the armrest frames 43 through a second pivot pin (B), which is disposed at an elevation above the first pivot pin (A) and which is parallel to the first pivot pin (A) Under this condition, the backrest frame 52 is pivotable about the first pivot pin (A) relative to the seat frame 51 and about the second pivot pin (B) relative to the respective one of the armrest frames 43 between the normal position, as best shown in FIG. 8, and a tilted position, as best shown in FIG. 3.

The footrest frame 53 is disposed frontwardly of the seat frame 51, and includes right and left side parts 530, each of which has a front end and a rear end opposite to the front end of a respective one of the right and left side parts 530 and pivoted to the front end of a respective one of the right and left side parts 510 of the seat frame 51 through a third pivot pin (C), which is parallel to the first pivot pin (A). When the backrest frame 52 is disposed at the normal position, the footrest frame 53 extends downwardly from the seat frame 51 (see FIG. 8).

The inclination-adjusting rods 54 are disposed below the seat frame 51, and extend in the first transverse direction. Each of the inclination-adjusting rods 54 has a rear end pivoted to the lower end 521 of a respective one of the right and left side parts 520 of the backrest frame 52 through a fourth pivot pin (D), which is parallel to and which is disposed at an elevation below the first pivot pin (A), and a front end opposite to the rear end of the respective inclination-adjusting rod 54. The front end of each of the inclination-adjusting rods 54 is pivoted to a respective one of the right and left side parts 530 of the footrest frame 53 at a position between the front and rear ends of the respective one one of the right and left side parts 530 of the footrest frame 53 such that rearward rotation of the backrest frame 52 from the normal position of FIG. 8 to the tilted position of FIG. 3 results in a forward movement of the inclination-adjusting rods 54, which in turn, results in upward rotation of the footrest frame 53 about the third pivot pins (C) (see FIG. 3).

Figure 7:
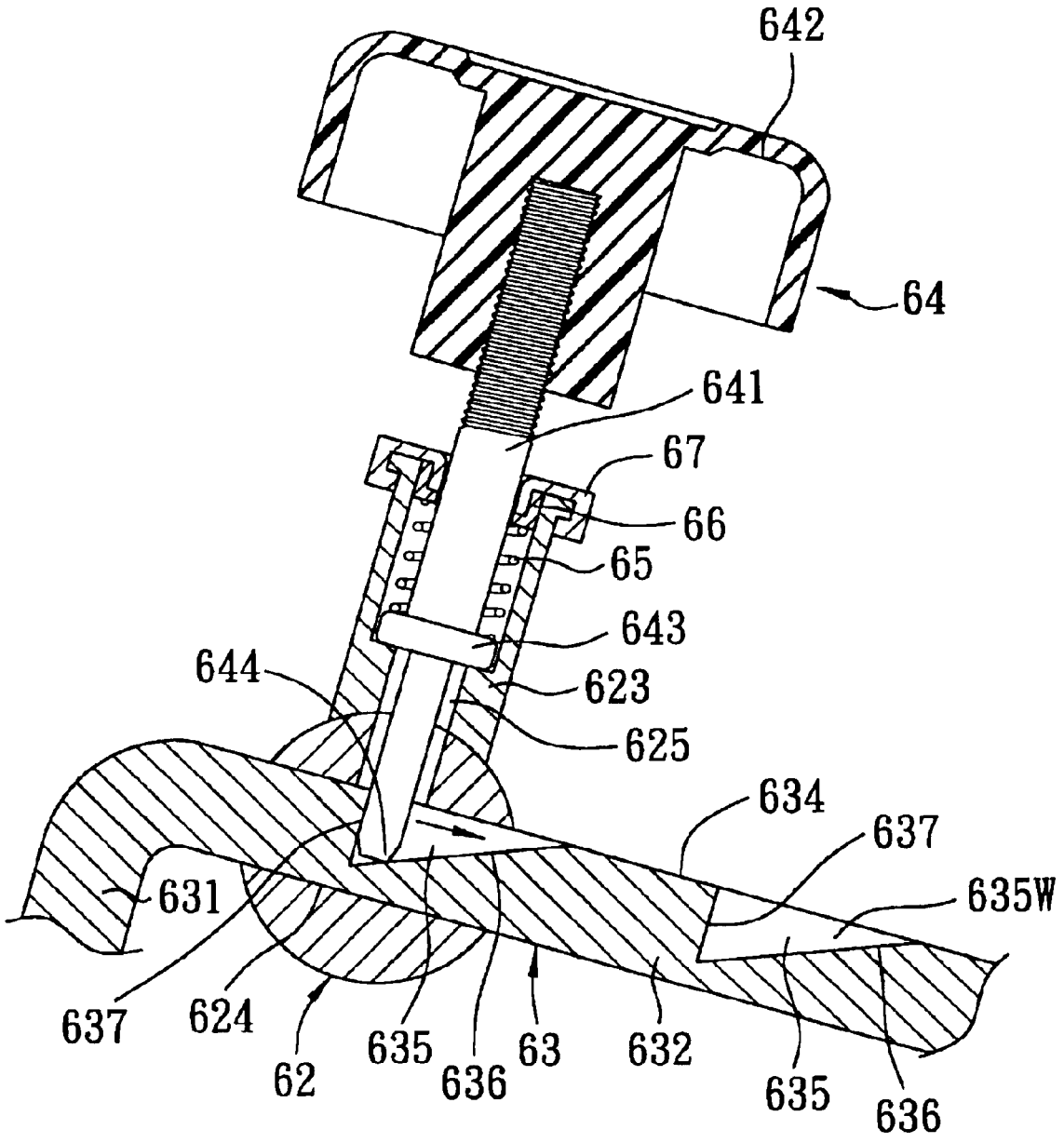
FIG. 7 is a fragmentary sectional side view illustrating the position adjusting member of the preferred embodiment in an engaging position.

The position adjusting member 6 includes a guiding rail 63, a sliding member 62, and a spring-biased latch 64. The guiding rail 63 is secured to a respective one of the armrest frame 43, and is disposed between the front and rear parts 431,432 of the respective one of the armrest frames 43. The guiding rail 63 is inclined relative to the lower reinforced part 434 of the respective one of the armrest frames 43, and has an L-shaped end 631 mounted in a tubular seat 435 formed on a front end of the lower reinforcing part 434 of the respective one of the armrest frames 43, and an engaging section 632 that extends rearwardly from the L-shaped end 631, that is fixed to the lower reinforcing part 434 of the respective one of the armrest frames 43 through a fastener screw 633, and that is formed with a plurality of spaced apart retaining grooves 635 which are aligned in the transverse direction. The sliding member 62 is in the form of a tubular member 62" that has a coupling part 622 connected securely to an adjacent one of the right and left side parts 510 of the seat frame 51 by means of a screw 61 for co-movement therewith, and that defines a rail passage 624 permitting extension of the engaging section 632 of the guiding rail 63 therethrough so as to be slidable on the guiding rail 63. The latch 64 is mounted on the tubular member 62", and has an engaging end 644 extending into the rail passage 624 in the tubular member 62" so as to engage releasably a selected one of the retaining grooves 635, thereby preventing sliding movement of the seat frame 51 on the engaging section 632 of the guiding rail 63. The engaging section 632 of the guiding rail 63 has a top surface 634 formed with the retaining grooves 635, each of which has a triangular cross-section. Each of the retaining grooves 635 is defined by a groove-defining wall 635W (see FIG. 7) that has a vertical front wall portion 637 extending inwardly and transversely from the top surface 634 of the engaging section 632, and an inclined wall portion 636 extending rearwardly and upwardly from a bottom end of the vertical front wall portion 637 so as to facilitate movement of the engaging end 644 of the latch 64 from one of the retaining grooves 635 in the guiding rail 63 to a desired one of the retaining grooves 635.

The support unit 30 includes an upright support frame and left and right suspending members 31. The upright support frame includes left and right upright supports 32 each having opposite top and bottom ends, and a transverse rod (not visible) fixed to the top ends of the left and right upright supports 32. The left and right suspending members 31 have upper ends connected swingably to the transverse rod, and lower ends connected swingably and respectively to the upper parts 433 of outer ones of the armrest frames 43 of the seat units S. Preferably, a canopy 3 is mounted on the top ends of the supports 32 for shading purposes.

Figure 9:
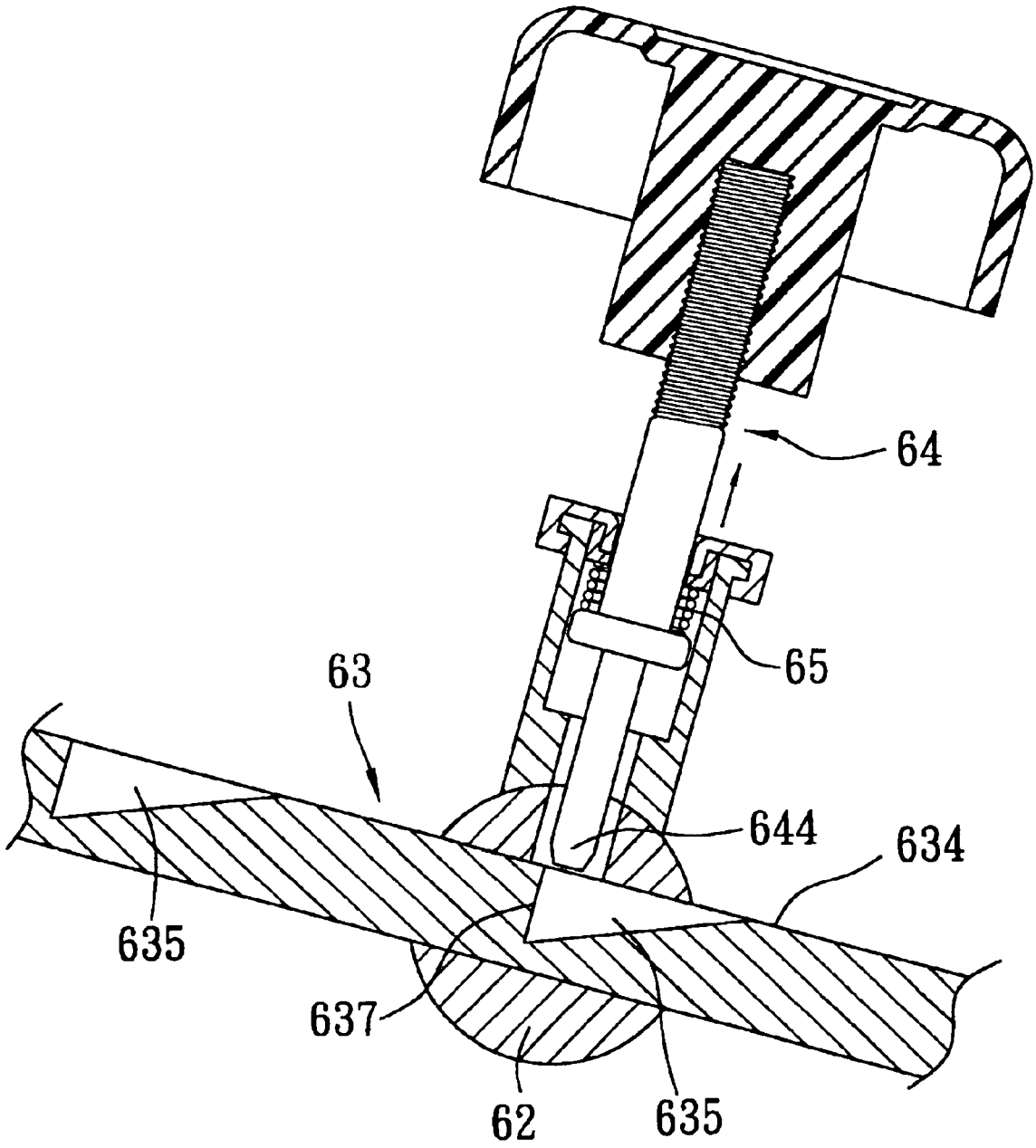
FIG. 9 is a fragmentary sectional side view of the position adjusting member of the preferred embodiment in a disengaging position.

In the preferred embodiment, the position adjusting member 6 further includes a latch-holding tube 623, a cap 67, a compression spring 65, and a pull knob 642. The latch-holding tube 623 projects radially and outwardly from the tubular member 62", defines a spring-retention space 625 that is in spatial communication with the rail passage 624 in the tubular member 62", and permits extension of the latch 64 therethrough. The cap 67 is mounted co-axially on the latch-holding tube 623 through a spring-retention sleeve 66. The compression spring 65 is disposed within the spring-retention space 625 in the latch-holding tube 623, and has one end abutting against the sleeve 66. The latch 64 extends through the cap 67, the latch-holding tube 623 and the compression spring 65 and into the rail passage 624, and is formed with an abutting flange 643 that projects radially and outwardly therefrom and that abuts against the compression spring 65 and is urged by the compression spring 65 to move toward the guiding rail 63. The latch 64 has a threaded operating end 641 opposite to the engaging end 644 and disposed above the latch-holding tube 623. The pull knob 642 is fixed on the operating end 641 of the latch 64 so as to facilitate pulling of the latch 64 away from the tubular member 62" (see FIG. 9) against urging action of the compression spring 65 for disengaging the engaging end 644 of the latch 64 from the selected one of the retaining grooves 635 in the guiding rail 63, thereby permitting sliding movement of the seat frame 51 and the tubular member 62" on the guiding rail 63. Under this condition, the backrest frame 52 of each seat unit 5 can be pushed rearward by body weight of the seated person so as to rotate the backrest frame 52 relative to the armrest frames 43 about the second pivot pins (B) and relative to the seat frame 51 about the first pivot pins (A), which in turn results in upward rotation of the footrest frame 53 about the third pivot pins (C).

Preferably, a horizontal support plate 38 (see FIG. 4) is disposed between and cooperates with inner ones of the armrest frames 43 of the seat units 5 to serve as a table.

In the present invention, due to the configuration of the position adjusting member 6, inclination adjustment is easy to conduct and the backrest frame 52 can be firmly held in position, thereby eliminating the problems associated with the position unit of the swing 1 disclosed in the aforesaid co-pending application.

With this invention thus explained, it is apparent that numerous modifications and variations can be made without departing from the scope and spirit of this invention. It is therefore intended that the invention be limited only as indicated in the appended claims.

I claim:

1. A swing comprising:

a seat unit including front and rear connecting rods extending in a longitudinal direction, two spaced apart armrest frames extending in a transverse direction relative to said longitudinal direction, one of said armrest frames having an upper part, and front and rear parts extending downwardly and respectively from two opposite ends of said upper part and connected respectively to said front and rear connecting rods, first and second pivot pins, a seat frame disposed above said front connecting rod between said armrest frames, and including a side part adjacent to said one of said armrest frames and having opposite front and rear ends, a backrest frame disposed rearwardly of said seat frame, and including a side part having a lower end disposed below said seat frame, an upper end opposite to said lower end, and an intermediate portion pivoted to said rear end of said side part of said seat frame through said first pivot pin and to said rear part of said one of said armrest frames through said second pivot pin, which is disposed at an elevation above said first pivot pin and which is parallel to said first pivot pin, and a position adjusting member including a guiding rail that is secured to said one of said armrest frames, that is disposed between said front and rear parts of said one of said armrest frames, and that is formed with a plurality of spaced-apart retaining grooves, a sliding member connected securely to said side part of said seat frame for co-movement therewith and defining a rail passage that permits extension of said guiding rail therethrough so as to be slidable on said guiding rail, and a spring-biased latch that is mounted on said sliding member and that has an engaging end extending into said rail passage in said sliding member and engaging releasably a selected one of said retaining grooves in said guiding rail so as to prevent sliding movement of said sliding member and said seat frame on said guiding rail; and a support unit including an upright support frame having opposite top and bottom ends, and left and right suspending members having upper ends connected swingably to said top end of said support frame, and lower ends connected swingably and respectively to said seat units.

2. The swing as defined in claim 1, wherein said sliding member is in form of a tubular member, said position adjusting member further including a latch-holding tube that projects radially and outwardly from said tubular member, that defines a spring-retention space in spatial communication with said rail passage in said tubular member, and that permits extension of said latch therethrough, a cap mounted co-axially on said latch-holding tube, and a compression spring disposed within said spring-retention space and abutting against said cap, said latch extending through said cap, said latch-holding tube and said compression spring and into said rail passage, and being formed with an abutting flange that projects radially and outwardly therefrom, that abuts against said compression spring and that is urged by said compression spring to move toward said guiding rail, said latch further having a threaded operating end opposite to said engaging end and disposed above said latch-holding tube, said position adjusting member further including a pull knob fixed on said operating end of said latch so as to facilitate pulling of said latch away from said tubular member against urging action of said compression spring for disengaging said engaging end of said latch from the selected one of said retaining grooves in said guiding rail, thereby permitting sliding movement of said seat frame and said tubular member on said guiding rail.

3. The swing as defined in claim 2, wherein said guiding rail has a top surface formed with said retaining grooves, each of said retaining grooves having a triangular cross-section and being defined by a groove-defining wall that has a vertical front wall portion that extends inwardly and transversely from said top surface of said guiding rail, and an inclined wall portion extending rearwardly and upwardly from a bottom end of said vertical front wall portion to facilitate removal of said engaging end of said latch from one of said retaining grooves in said guiding rail to a desired one of said retaining grooves.

* * * * *